US011578412B1

(12) United States Patent
Garza et al.

(10) Patent No.: US 11,578,412 B1
(45) **Date of Patent: *Feb. 14, 2023**

(54) SACRIFICIAL ANODES FOR CATHODIC PROTECTION FOR PRODUCTION VESSELS, STORAGE VESSELS AND OTHER STEEL STRUCTURES

(71) Applicant: GALVOTEC ALLOYS, INC., McAllen, TX (US)

(72) Inventors: Rogelio E. Garza, Mission, TX (US); Edgar H. Garza, Mission, TX (US); James Lenar, McAllen, TX (US)

(73) Assignee: GALVOTEC ALLOYS, INC., McAllen, TX (US)

( * ) Notice: Subject to any disclaimer, the term of this patent is extended or adjusted under 35 U.S.C. 154(b) by 357 days.

This patent is subject to a terminal disclaimer.

(21) Appl. No.: 16/792,502

(22) Filed: Feb. 17, 2020

Related U.S. Application Data

(63) Continuation of application No. 15/448,139, filed on Mar. 2, 2017, now Pat. No. 10,604,851.

(60) Provisional application No. 62/302,492, filed on Mar. 2, 2016.

(51) Int. Cl.
*C23F 13/10* (2006.01)
*C23F 13/18* (2006.01)

(52) U.S. Cl.
CPC ..... *C23F 13/10* (2013.01); *C23F 13/18* (2013.01)

(58) Field of Classification Search
CPC .. C23F 13/02–13/22; C23F 2213/00–2213/32; F24H 9/40–9/45; F16L 58/00–58/188; C01G 75/00–75/04
See application file for complete search history.

(56) References Cited

U.S. PATENT DOCUMENTS

| | | | | |
|---|---|---|---|---|
| 629,092 | A | 7/1899 | Ross | |
| 2,805,987 | A | 9/1957 | Thorn, Jr. et al. | |
| 3,046,213 | A | 7/1962 | Bender | |
| 3,058,086 | A | 10/1962 | Zwanzig | |
| 3,138,549 | A * | 6/1964 | Adair | C23F 13/18 204/196.18 |
| 3,956,819 | A | 5/1976 | Auger | |
| 7,996,981 | B2 | 8/2011 | Dole et al. | |
| 10,604,851 | B1 * | 3/2020 | Garza | C23F 13/18 |
| 2007/0029191 | A1 | 2/2007 | Sewell | |

* cited by examiner

*Primary Examiner* — Alexander W Keeling
(74) *Attorney, Agent, or Firm* — Garvey, Smith & Nehrbass, Patent Attorneys, L.L.C.; Seth M. Nehrbass; Charles C. Garvey, Jr.

(57) ABSTRACT

A vessel corrosion protection apparatus includes a specially shaped anode having a smaller diameter, longer portion and a shorter portion with radially extending ribs that are cast with the anode and configured to engage the inside surface of a section of pipe that extends away from the vessel outer wall. A vessel corrosion protection apparatus includes a specially shaped anode having a smaller diameter, longer portion and a shorter portion with radially extending ribs that are configured to engage the inside surface of a section of pipe that extends away from the vessel outer wall, the anode connected to a plate not made of anodic material and which has a face free from penetrations which would allow liquid penetration through the plate when the anode is attached to a vessel.

4 Claims, 11 Drawing Sheets

SACRIFICIAL ANODES FOR CATHODIC PROTECTION FOR PRODUCTION VESSELS, STORAGE VESSELS AND OTHER STEEL STRUCTURES

CROSS-REFERENCE TO RELATED APPLICATIONS

This is a continuation of U.S. patent application Ser. No. 15/448,139, filed 2 Mar. 2017, now issued as U.S. Pat. No. 10,604,851 on 31 Mar. 2020, which is a nonprovisional patent application of U.S. Provisional Patent Application Ser. No. 62/302,492, filed 2 Mar. 2016, both of which are hereby incorporated herein by reference.

Priority of our U.S. Provisional Patent Application Ser. No. 62/302,492, filed 2 Mar. 2016, which is incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a sacrificial anode for use in the anti-corrosive protection of production vessels.

2. General Background of the Invention

Sacrificial anodes are used for protection against corrosion of production vessels, such as heater treaters, tanks, pressure vessels, and other production vessels. Anodes for these applications should be simple to replace when consumed.

In typical embodiments, 3 inch diameter×30 inch length and 3 inch diameter×60 inch length cylindrically shaped anodes are mounted in a holder or head such as a commercially available Adair "Red-Head" or "Blue-Head" anode mounting head. These types of anodes can be easily installed in a standard schedule 40 or schedule 80 pipe nipple (e.g., four inch (4")) with a coupling such as a Victualic® coupling.

In prior art applications, aluminum anodes contain nominal amounts of indium, zinc, and silicon that deliver −1.10 volts (with respect to Ag/AgCL reference cell). These anodes deliver protection in produced brines with elevated temperatures. Nominal anode capacity in ambient sea-water is 1150 ampere hours per pound. Zinc and Magnesium Anodes in various configurations are also available. Typical applications include internal protection of salt water storage tanks, heater treaters, ChemElectric units, skimmers, heat exchangers, oil-separation vessels, and storage tanks. There can also be custom anodes, mounting assemblies can be fabricated to fit any installation requirement. Elimination of a red head or blue head or other mounting head would simplify the product and potentially reduce the cost.

In the prior art a fiberglass cap is bolted to the end of a cast anode. The space between the anode and the cap is filled with epoxy. The anode is then inserted into an anode tube in the tank and a two-piece sleeve with a rubber gasket is used to attach the anode to the tank (or other vessel to be protected from corrosion). A wire can be run from a bolt to a portion of the tank to provide good electrical contact between the anode and the tank.

The following possibly relevant U.S. Patents are incorporated herein by reference:

U.S. Pat. Nos. 629,092; 2,805,987; 3,046,213; 3,058,086; 3,138,549; and 3,956,819.

U.S. Patent Application Publication No. 2007/0029191.

BRIEF SUMMARY OF THE INVENTION

The apparatus of the present invention provides a sacrificial anode for production vessels. In one embodiment, it can be designed to accommodate standard pipes.

The present invention simplifies the installation of anodes in heater treater tanks or like vessels. An anode is preferably cast in a shape to fit directly into an anode tube mounted to the tank, without a fiberglass cap (though it could for example be machined down from a larger piece of metal). Another option might be to add the ribs to a cylindrical anode using for example steel, neoprene, vinyl, phenolic, acrylic, high-temperature plastic shrink wrap, or ceramic (in other words, the ribs can be made of for example steel, neoprene, vinyl, phenolic, acrylic, high-temperature plastic shrink wrap, or ceramic). In such a case, one might make for example a steel sleeve having steel ribs protruding outwardly from the sleeve. Alternatively, one could make a steel cage acting as a centralizer with ribs connected to one another and to the anode. High temperature heat shrink tubing technology exists that should work and can endure the conditions where anodes of the present invention are intended to be used (extreme, harsh, continuous high temperature environments). A few examples can be found at http://www.texloc.com/hs home.html, http://www.insultab.com/products/extreme-environment-hst.html, and https://www.zeusinc.com/products/heat-shrinkable-tubing/peek-shrink.

The anode has a shape that approximates that of the combination of the prior art anode and the fiberglass cap. A metal end cap can be clamped to the tank in the same manner as in the prior art. A wire can be attached from the metal end cap to the tank to enable electrical contact between the anode and the tank.

The end of the anode may be coated with red or blue material to make it easier for workers to use them without learning a new system (red is slightly larger in diameter than blue, as it is used in thinner gauge tanks which have slightly larger diameter openings for the anodes).

The anodes can be cast to encapsulate an iron rod or connect with an iron rod. The rod can be threaded to allow a metal cap to be screwed to the proximal end. The cap can be included in the mold when the anode is cast. The cap is preferably threaded to the rod, though the cap could be attached to a stem which would attach to the rod (such as via a coupling).

Currently red heads are fiberglass caps that are placed on the anode and then filled with epoxy in between cap and anode (a time intensive process). The outer limits of the centralizing fins of the blue heads are slightly smaller in diameter than the centralizing fins of the red heads. The blue heads are sometimes just a shaved-down red head.

The present invention comprises an anode that has the centralizer fins cast into the anode, thereby eliminating the need for a separate cap and epoxy. One can add an epoxy or other material paint coating over the anodes of the present invention to indicate size differences and/or create such as a seal between the anode and cap.

Those sized to replace red heads could be painted red in the same area where the red head fiberglass normally would be located. Those sized to replace blue heads could be painted blue in the same area where the blue head fiberglass normally would be.

Typically, one cannot monitor an anode such as the present invention without the epoxy coating and a wire connection. Monitoring is not typically needed; however, a gasket could be added to allow for the monitoring if desired.

The present invention allows for more efficient and cost-effective manufacture of anodes. The figures show preferred embodiments of the present invention, including a ribbed heater treater anode metal end cap with ribs cast into anode body. The present invention is a sacrificial anode for production, storage, other vessels or other steel structures, for example, designed to accommodate standard and nonstandard pipes, nozzles, and couplings. The anode may be from materials such as aluminum, zinc, magnesium, graphite, silicon-iron, or any other anodic materials, for example. In some embodiments, a phenolic (or electrical isolator) gasket may be included.

The anode may be mounted in horizontal or vertical positions, for example. In some embodiments, the anode is designed for use with a Victaulic® coupling (e.g., see U.S. Pat. No. 7,996,981 which is incorporated herein by reference).

The present invention allows for elimination of the "red" head or "blue" head distinctions of the prior art through the addition of cast-on ribs or mechanically attached or installed ribs or centralizers (which can be made of the same material as the anodes or other materials such as described above). The ribs facilitate installation and also support, holding the anode in place like a centralizer. The elimination of a red head or blue head fiberglass cap simplifies the product and potentially reduces the cost.

Several advantages of the present invention all for the elimination of complex assembly and the elimination of potential leakage. The substitution of the present invention for the epoxy, plastic, fiberglass red head/blue head system of the prior art would be an improvement with regard to safety, performance, quality, reliability, longevity, simplicity, storage space, and fabrication time. It is also more environmentally friendly as the resin of the fiberglass caps is not needed. Also, the metal caps could be reused.

A preferred embodiment of the present invention includes a sacrificial anode system for the cathodic protection of vessels or tanks having a sacrificial anode that may be composed of aluminum, zinc, magnesium, graphite, silicon-iron, or other anodic material that has ribs that are cast on, cast in, machined or otherwise affixed. Anode ribs may run the entire length of the anode or extend to a predetermined length.

A ribbed sacrificial anode assembly may include a solid steel cap where the ribbed anode may be directly cast onto steel end cap. A ribbed sacrificial anode assembly may include a solid steel cap where ribbed anode may be attached mechanically to steel end cap by threads or other assembly techniques. The ribbed sacrificial anode assembly of the present invention may include a solid steel cap and electrical isolation. A ribbed sacrificial anode assembly of the present invention may include a solid steel cap without electrical isolation. A ribbed sacrificial anode assembly of the present invention can be designed to be used in conjunction with Victaulic® coupling or other type of couplings. The cap can be made of any suitably strong and high temperature resistant material, such as fiberlass or phenolic sheet material, but is preferably made of steel (and preferably it is not made of anodic material, as it might corrode).

A preferred embodiment of the present invention may include ribs cast onto sacrificial anode body act as centralizer and support for the anode upon insertion into vessel nozzle or insertion port. A solid steel cap can be used to eliminate any potential leaking and eliminate the need for quality control leak testing in a pressure chamber. Improvements from prior art include elimination of epoxy and plastic/fiberglass assembly which is a known to break down over time and develop leaks. The solid steel anode cap is preferably impact resistant, pressure resistant and temperature resistant, which provides a clear advantage over prior art.

In certain embodiments, there is no loose or additional hardware required to fix the cap to the anode with current invention.

Typical sizes of a preferred embodiment of the present invention may be 3 inches in diameter×30 inches in length and 3 inches in diameter×60 inches in length. However, a person having the ordinary skill in the art will understand that other sizes may be fabricated. The anode is typically connected to the vessel via a standard coupling such as a Victaulic® Coupling. An electrical connection may be attained by a connection wire lead from the outside of the anode to the tank.

In a typical field application, the invention may be used for the cathodic protection of the internal portion of water storage tanks, heater treaters, chem electric units, skimmers, heat exchangers, oil separation vessels, and storage tanks, for example. The sacrificial anode assembly may be placed into a couple, nozzle, or port specifically designed to utilize a clamp or support such as a Victaulic® (or similar) coupling. The anode material may be less noble than the steel wall of the vessel it protects and will become sacrificial, thus providing the protective current required to protect the internal submerged portion of the vessel from corrosion.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

s

DETAILED DESCRIPTION OF THE INVENTION

Figure 1:
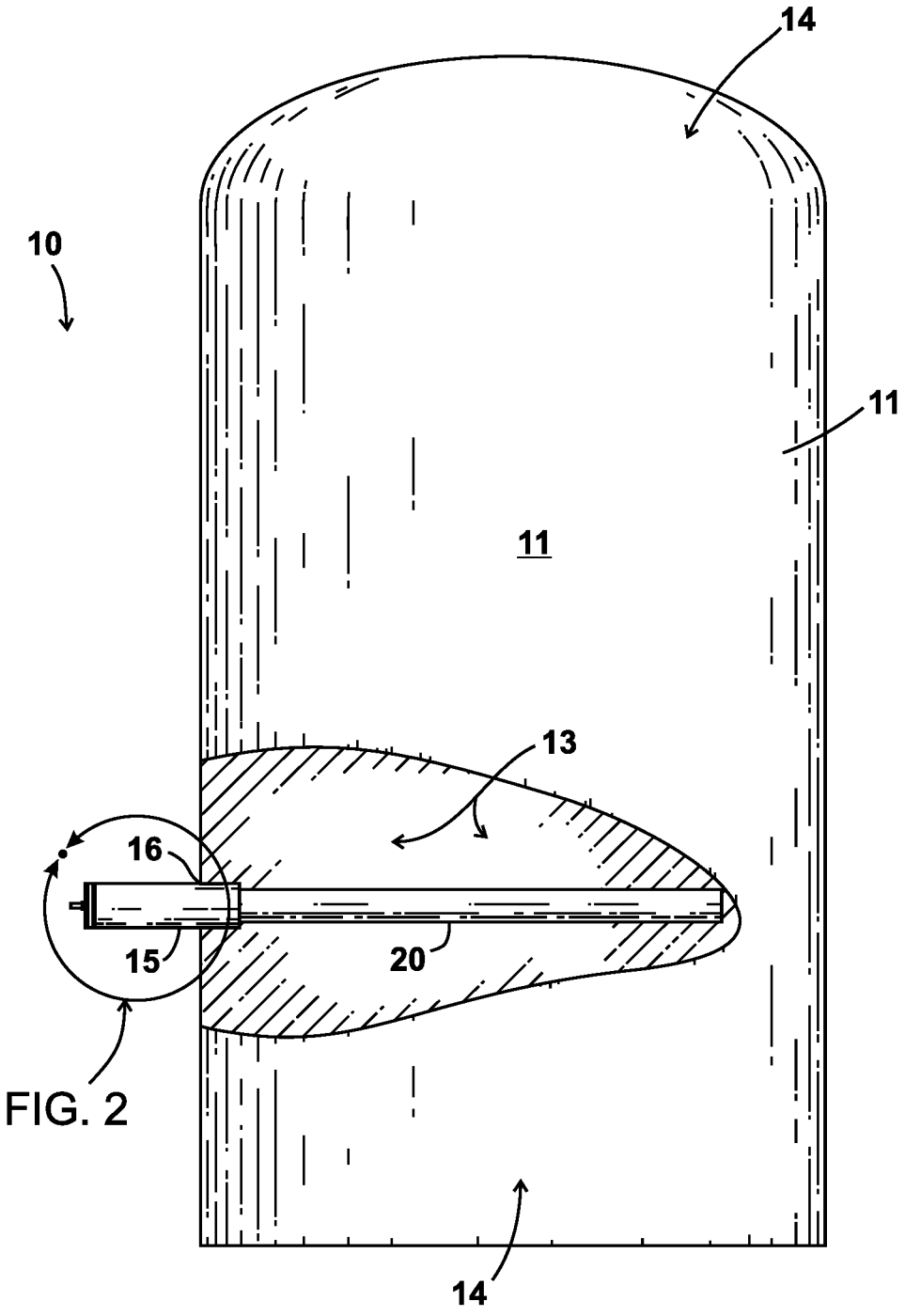
FIG. 1 is a partial cut-away elevation view of a preferred embodiment of the apparatus of the present invention.
Figure 2:
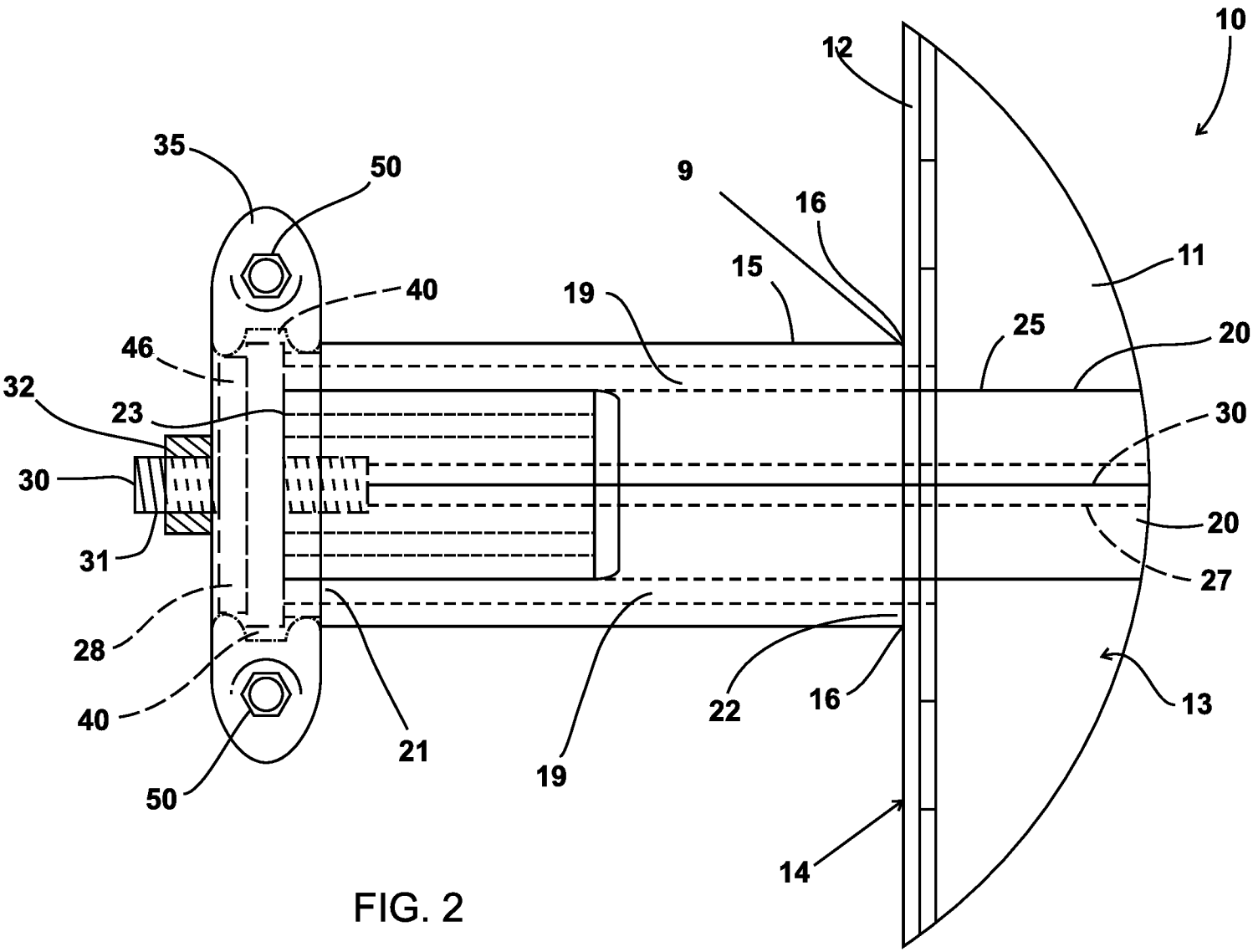
FIG. 2 is a partial sectional elevation view of a preferred embodiment of the apparatus of the present invention.
Figure 3:
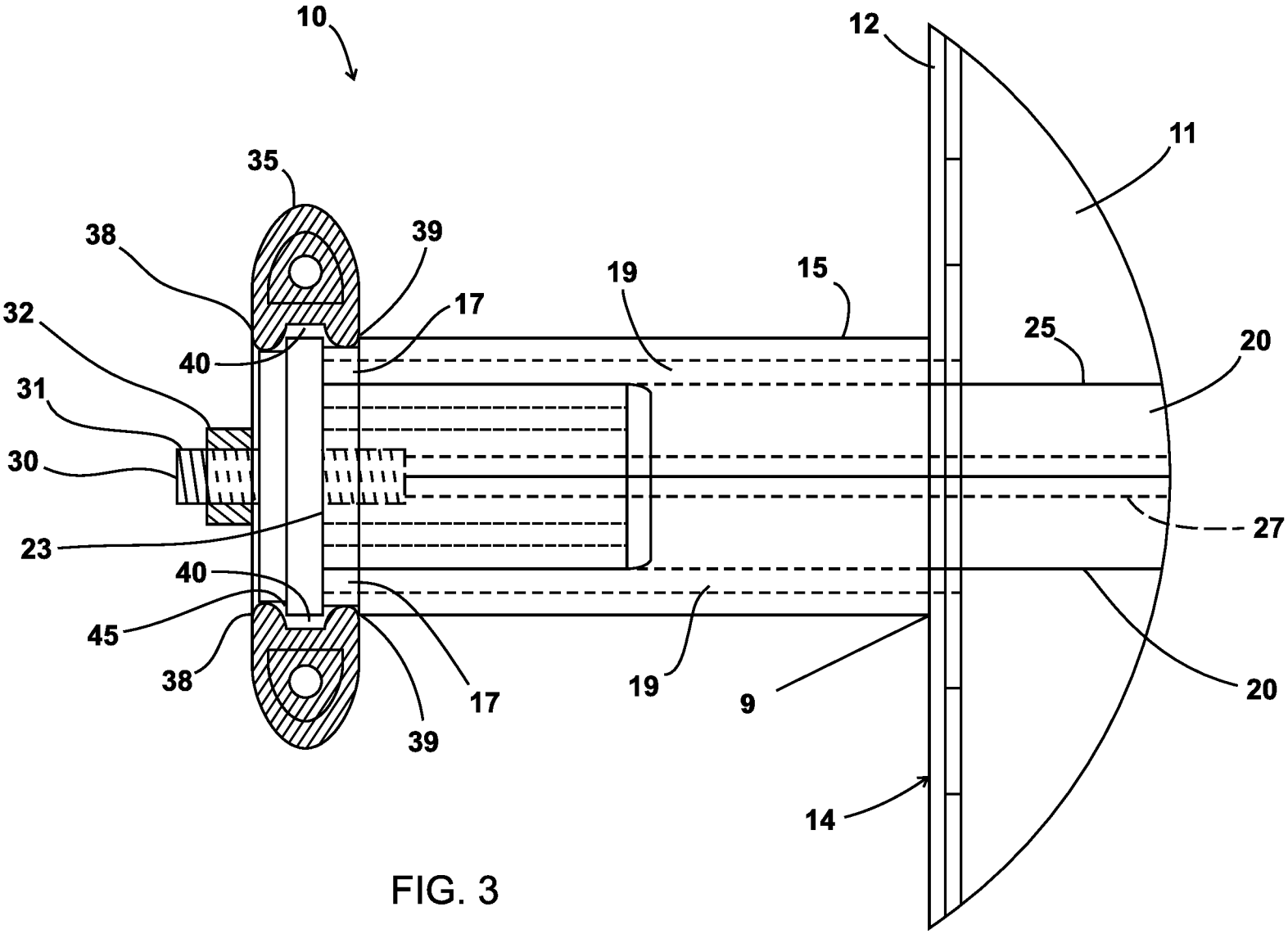
FIG. 3 is a partial sectional elevation view of a preferred embodiment of the apparatus of the present invention.

FIGS. 1-10 show the preferred embodiment of the apparatus of the present invention designated generally by the numeral 10 in FIGS. 1-3. Anode apparatus 10 is used in combination with a selected vessel or tank 11 as shown in FIG. 1. The vessel, tank, heater treater or other device 11 typically provides a vessel or tank wall 12 to which is attached a generally cylindrically shaped pipe section 15. Pipe section 15 can be for example schedule 40 or schedule 80 pipe. Tank wall 12 surrounds a tank interior 13. The outside surface of the vessel or tank wall 12 provides a vessel or tank exterior 14.

Pipe section 15 can be generally cylindrically shaped, providing a generally cylindrically shaped pipe section bore 19. A weld 16 can be used to join pipe section 15 to vessel or tank wall 12. In FIGS. 2-3, the pipe section 15 provides an outer surface with annular groove 17 which receives a protruding rib of a connecting or coupling part 35 or 36 and a gasket 37. The coupling parts 35, 36 can each provide spaced apart annular ribs 38, 39. An annular space 40 is provided in between the ribs 38, 39. The annular space 40 is receptive of gasket 37. The coupling parts 35, 36 and gasket 37 can be a commercially available coupling such as a Victaulic® Model 77 coupling. Such a coupling can also be seen in prior U.S. Pat. No. 7,996,981 entitled "METHOD OF JOINING PIPES IN END TO END RELATION", issued Aug. 16, 2011. U.S. Pat. No. 7,996,981 is hereby incorporated herein by reference.

Figure 4:
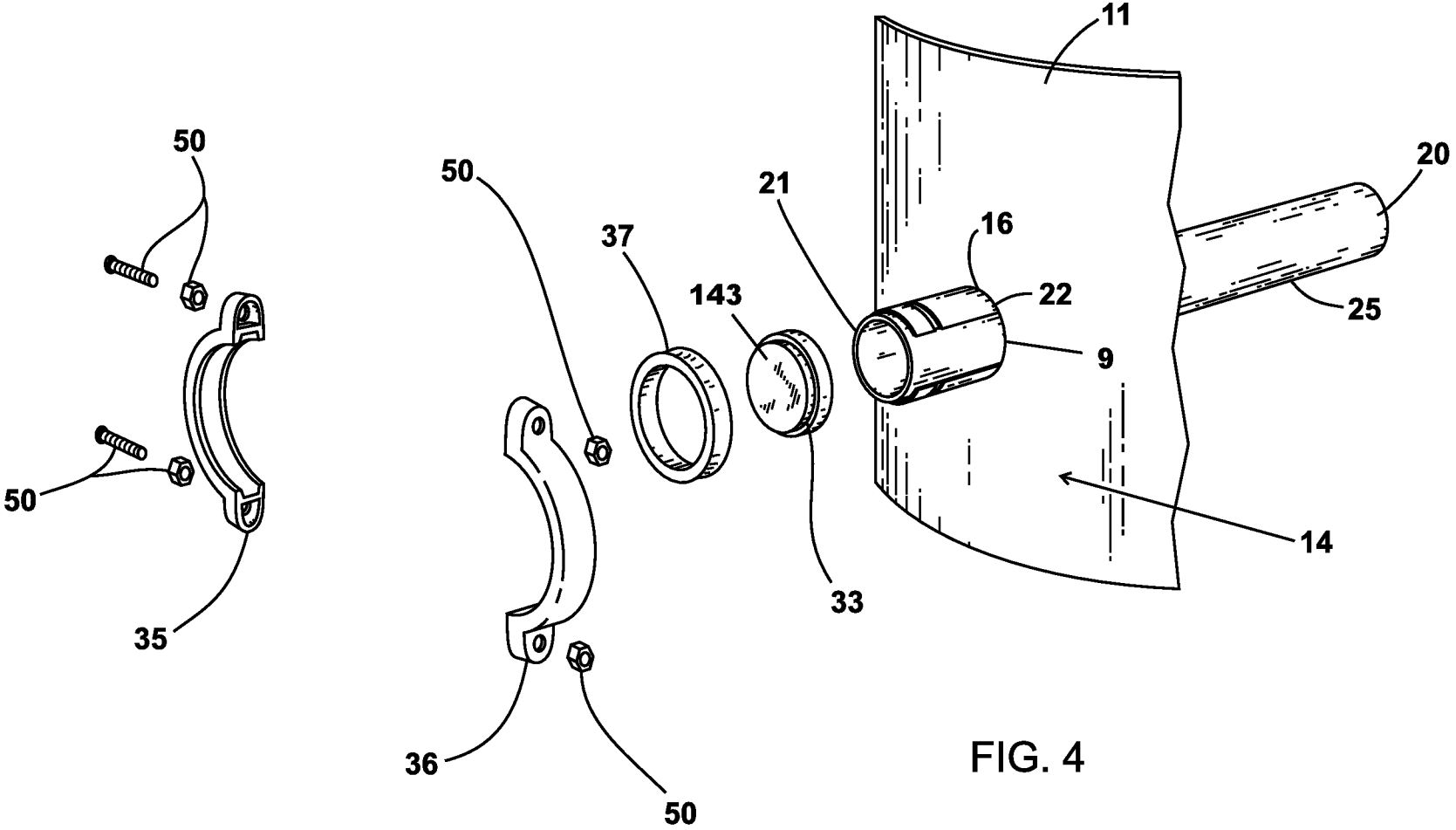
FIG. 4 is a partial perspective exploded view of a preferred embodiment of the apparatus of the present invention.
Figure 5:
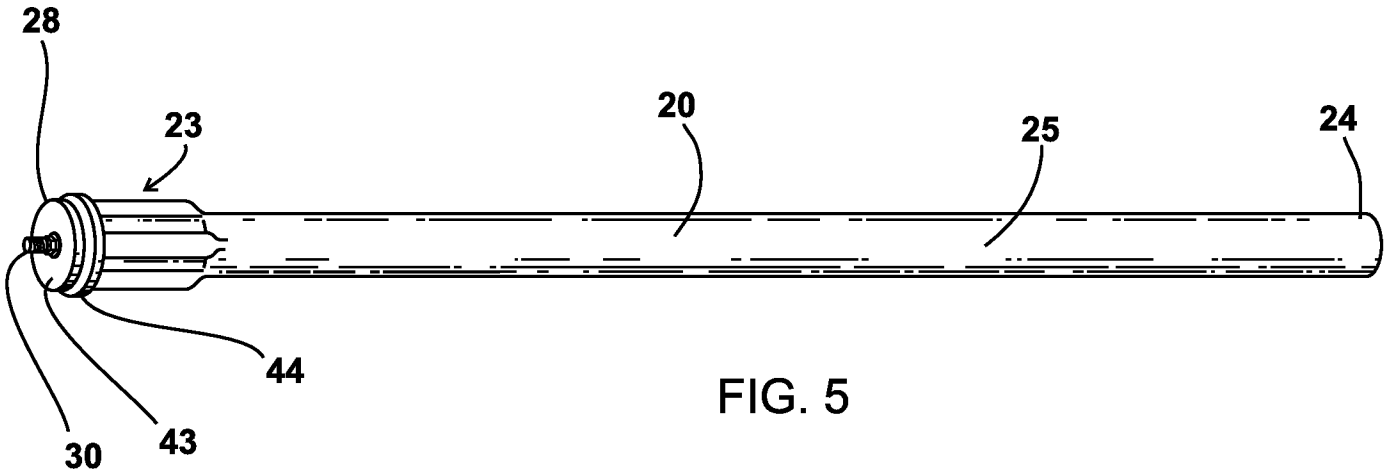
FIG. 5 is a partial perspective view of a preferred embodiment of the apparatus of the present invention.
Figure 6:
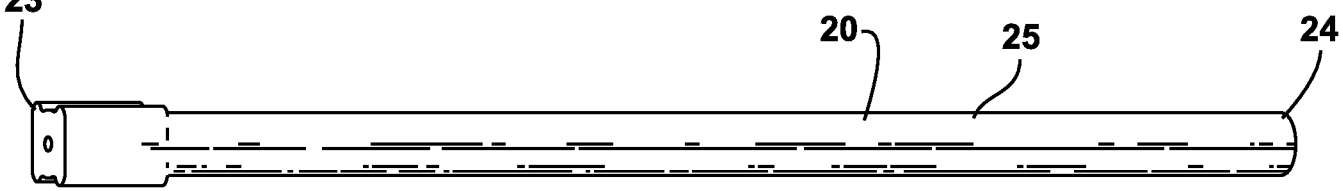
FIG. 6 is a partial perspective view of a preferred embodiment of the apparatus of the present invention.
Figure 7:
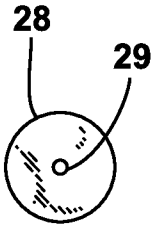
FIG. 7 is a partial end view of a preferred embodiment of the apparatus of the present invention.

In FIGS. 1-10, there is shown an anode 20 of configuration of the present invention. Anode 20 has an outer end 23 and an inner end 24, as shown in FIGS. 5 and 6. When assembled to pipe section 15, anode outer end 23 registers in bore 19 of pipe section 15. As will be discussed more fully hereinafter, outer end 23 of anode 20 can be fitted with a circular plate 28 or 33 which is attachable to an internally placed elongated rod 30 having an external threads 31.

Pipe section 15 has outer end 21 and inner end 22 as shown in FIG. 4. Inner end 22 is attached to vessel 11 using a weld or weldment 16. Outer end 21 of pipe section 15 engages or abuts a selected circular plate 28 or 33. Inner end 24 of anode 20 extends into vessel 11 interior as shown in FIG. 1.

Anode 20 has a cylindrically shaped section 25 that extends over a majority of its length as seen in FIGS. 1-7. Anode 20 has a plurality of projections, ribs or fins 26 that area part of the anode metal material which can be any suitable anode material as shown in FIGS. 5, 6, 9, and 10. Each projection 26 has radially extending surfaces 47, 48. Anode 20 has an anode central longitudinal bore 27 occupied by rod 30 having external threads 31, as shown in FIGS. 2, 3, and 5.

Figure 9:
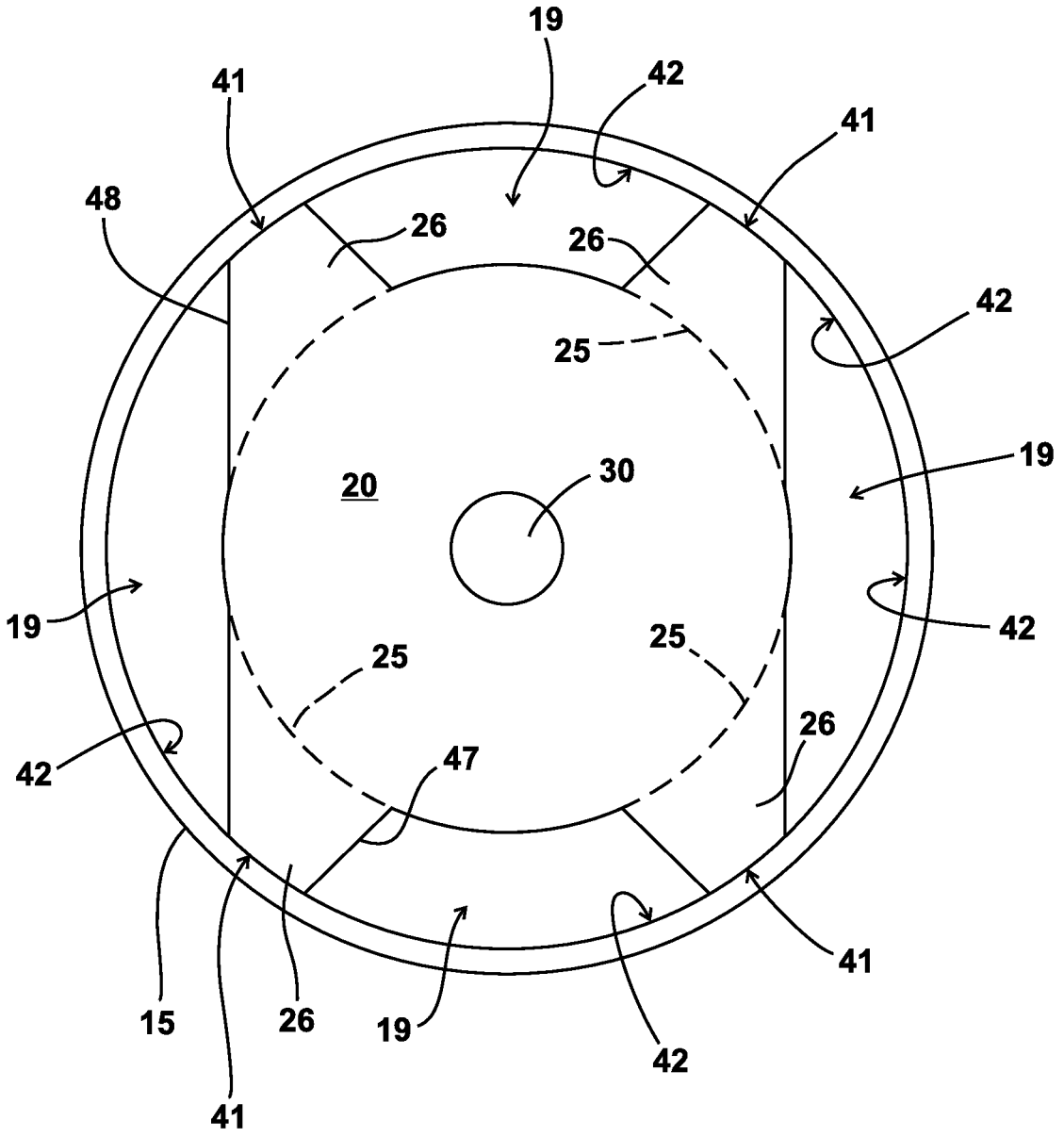
FIG. 9 is an end view of a preferred embodiment of the apparatus of the present invention.
Figure 10:
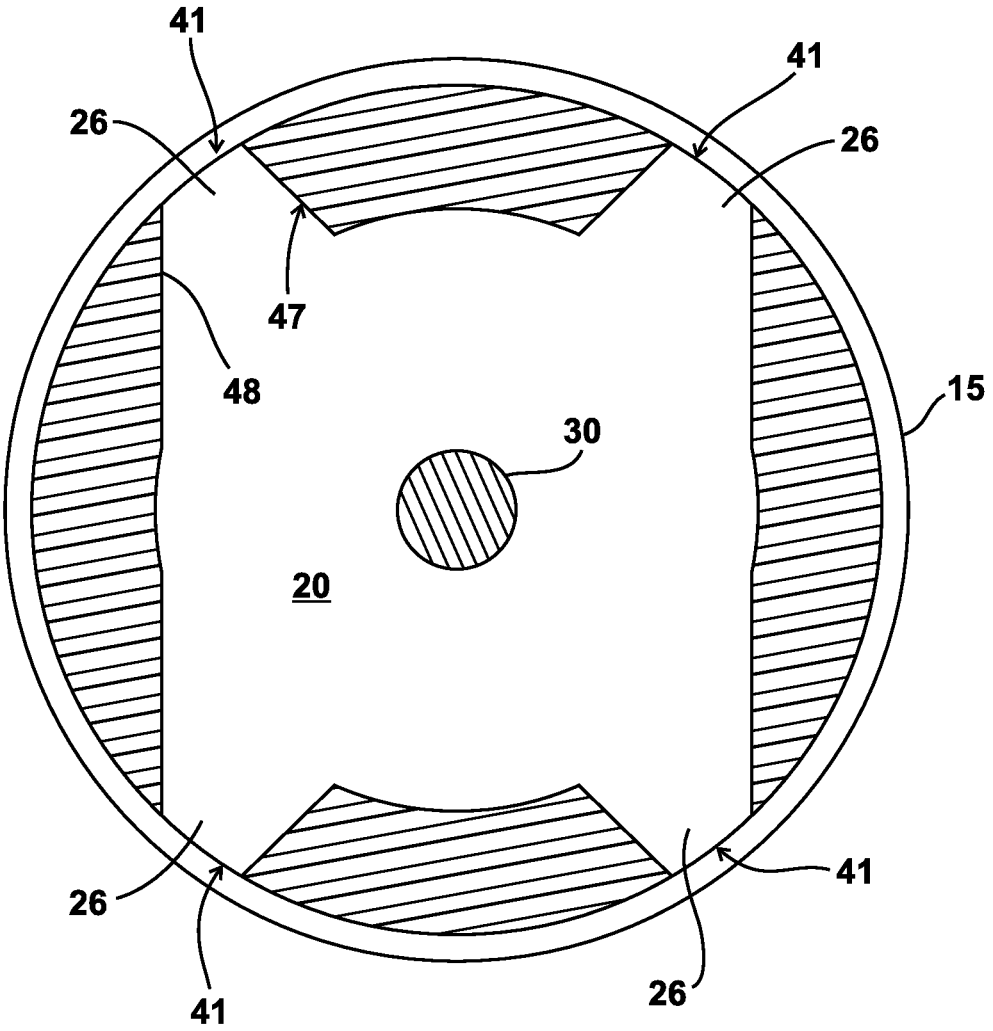
FIG. 10 is an end view of a preferred embodiment of the apparatus of the present invention.
Figure 18:
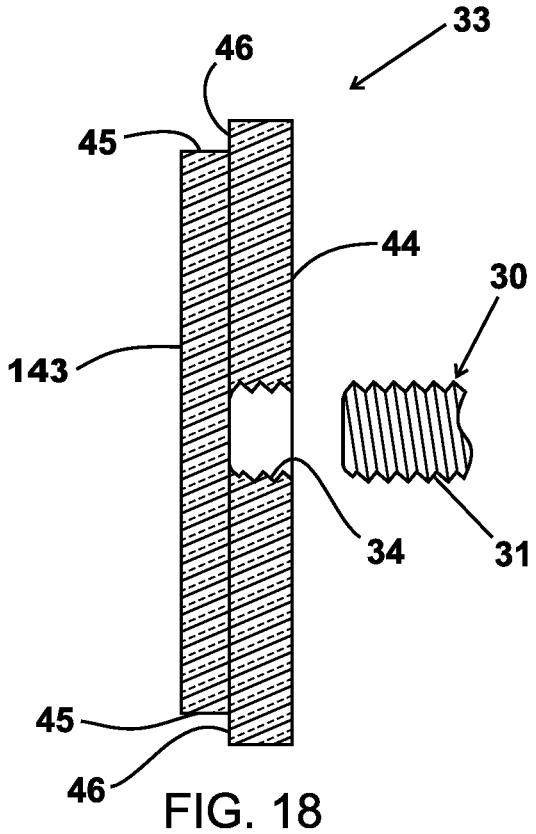

Circular plate 28 can be fitted to anode 20 outer end 23 wherein plate opening 29 enables the passage of rod 30 therethrough. See for example, FIGS. 5, 11, 12, and 14. Circular plate 28 can then be fitted to rod 30 and thus to anode 20 using one or more nuts 32. Alternatively, the circular plate 33 can be as shown in FIGS. 4, and 15-18. Each plate 28, 33 has a smaller diameter section 43 (143 in plate 33) and a larger diameter section 44 as shown in FIGS. 13, 14, 17, and 18. Annular shoulder 45 is provided where smaller diameter section 43, 143 meets larger diameter section 44. An annular surface at 46 provides a recess that is occupied by annular rib 38 of each coupling part 35, 36. In FIG. 18, circular plate 33 has an internally threaded opening 34 that can form a connection with the external threads 31 of rod 30. In FIGS. 5, 6, 8, 9, and 101, there can be seen a plurality of four projections, ribs or fins 26. In FIGS. 9-10 each of the fins 26 can be provided with an outermost curved surface at 41 that tracks the internal surface 42 of pipe section 15 as seen in FIG. 9. These fins 26 may be in other configurations. Preferably, there are at least three fins 26 to centralize the anode 20 in the pipe 15. More preferably, there are between three and six fins 26. Most preferably, there are four fins 26.

Figure 8:
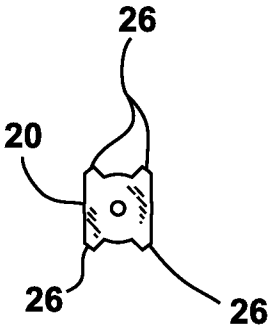
FIG. 8 is a partial end view of a preferred embodiment of the apparatus of the present invention.

Although the anode 20 is shown in the figures as generally cylindrical with ribs at one end, the anodes could instead, for example, be rectangular in cross section, have ribs extending the entire length, or be of any other shape in cross section that would allow for easy insertion into the pipe section 15 of the vessel (such as the shape shown in FIG. 8).

The present invention preferably includes a vessel corrosion protection apparatus 20 for a vessel 11 having a vessel wall 12 surrounding a vessel interior 13, a wall opening 9 through the vessel wall 12, a section of pipe 15 connected to the vessel wall 12 at the wall opening 9, said section of pipe 15 having inner and outer end portions and a pipe section inner surface 42 surrounding a pipe section bore 19, the apparatus comprising:

an anode 20 mountable to said pipe section 15 and occupying all or part of said pipe section bore 19 when so mounted;

the anode 20 having an inner end portion 24 that extends into said vessel interior 13 when mounted to said pipe section 15;

the anode 20 having an outer end portion 25 that occupies the pipe section bore 19 in between said inner 22 and outer 21 pipe end portions when mounted to said pipe section 15, said anode outer end portion 25 including a plurality of radially extending projections 26 that are part of the anodic material and that engage the pipe section inner surface 42 when the anode 20 is mounted to said pipe section 15.

The present invention preferably includes a vessel 11 and vessel corrosion protection apparatus, or anode 20, as shown in FIGS. 1-4. Preferably, the invention comprises a vessel 11 having a vessel wall 12 surrounding a vessel interior 13;

a wall opening 9 through the vessel wall 12;

a section of pipe 15 connected to the vessel wall 12 at the wall opening 9, preferably via a weld 16, said section of pipe 15 having inner 22 and outer 21 end portions and a pipe section inner surface 42 surrounding a pipe section bore 19;

an anode 20 mounted to said pipe section 15 and occupying all or part of said pipe section bore 19;

the anode 20 having an inner end 24 portion that extends into said vessel interior 13;

the anode 20 having an outer end 23 portion that occupies the pipe section bore 19 in between said inner and outer pipe end portions 22, 21, said anode outer end portion 23 including a plurality of radially extending projections 26 that are part of the anodic material and that engage the pipe section inner surface 42.

Preferably, each projection 26 has a curved outer surface 41 spaced farthest from said central longitudinal axis, as shown in FIGS. 9 and 10.

Preferably, the anode 20 is of a sacrificial metallic material, such as magnesium, aluminum, zinc, and alloys thereof.

Preferably, a majority of the length of the anode 20 does not have said projections 26, as shown in FIGS. 5 and 6.

Preferably, a majority of the length of the anode 20 is generally cylindrically shaped as shown in FIG. 5.

In some embodiments, the apparatus further comprises an elongated rod 30 embedded in said anode 20, as shown in FIGS. 2, 3, and 5.

Preferably, the rod 30 protrudes from one end of said anode 20.

Preferably, at least part of said rod 30 is externally threaded with threads 31, as shown in FIGS. 2, 3, 14, and 18.

In some embodiments, the present invention further comprises a plate 28, 33 connected to one end of said anode 20 and a coupling 35, 36 that attaches said plate 28, 33 to said pipe section 15. See FIGS. 4-5 and 11-18.

Preferably, the pipe section 15 has an annular groove 17 and the coupling 35, 36 attaches to said annular groove 17, as shown in FIGS. 2-3. Additionally, preferably, the circular plate 28, 33 has an annular recess 45, 46 and the coupling 35, 36 attaches to both said annular groove 17 and said annular recess 45, 46, as shown in FIGS. 2-3, 13-14, and 17-18.

Preferably, the invention further comprises a gasket 37 positioned in between the annular groove 17 and the annular recess 45, 46, as shown in FIG. 4 to prevent fluid flow between the coupling and the plate 28, 33.

Preferably, the plate 28 has a plate opening occupied by the rod 30 and wherein the plate 28 is bolted to the anode 20 with a nut 32 that attaches to the rod 30 as shown in FIGS. 2-3.

Preferably, the plate 28, 33 has a plate internally threaded opening 34 occupied by the rod 30 and wherein the plate 28, 33 is threaded to the rod 30 at said internally threaded opening 34.

In another preferred embodiment, the present invention is a vessel 11 and vessel corrosion protection apparatus or anode 20, comprising:

a vessel 11 having a vessel wall 12 surrounding a vessel interior 13;

a wall opening 9 through the vessel wall 12;

a section of pipe 15 connected to the vessel wall 12 at the wall opening 9, said section of pipe 15 having inner 22 and outer 21 end portions and a pipe section inner surface 42 surrounding a pipe section bore 19;

an anode 20 mounted to said pipe section 15 and occupying all or part of said pipe section bore 19;

the anode 20 having an inner end portion 24 that extends into said vessel interior 13;

the anode 20 having an outer end portion 23 that occupies the pipe section bore 19 in between said inner and outer pipe end portions 22, 21;

wherein the anode outer end portion 23 has a plurality of radially extending projections 26 that are cast with the cylindrical part of the anodic material and that are shaped to engage the pipe section inner surface 42, as shown in the figures.

Preferably, each projection 26 has a curved outer surface 41 spaced farthest from said central longitudinal axis, as shown in FIGS. 9-10.

Preferably, a majority of the length of the anode 20 does not have said projections 26, as shown in FIGS. 2-3 and 5-6.

Preferably, a majority of the length of the anode 20 has a uniform diameter, as shown in FIGS. 1, 5, and 6.

In some embodiments, the invention further comprises an elongated rod 30 embedded in said anode 20, as shown in FIGS. 1-3, and 5.

Preferably, the rod 30 protrudes from an end of said anode 20 next to said projections 26, as shown in FIGS. 1-3, and 5.

Preferably, an exposed part of said rod 30 is externally threaded 31 as shown in FIGS. 2-3.

In some embodiments, the invention further comprises a plate 28, 33 threadably connected to one end of said anode 20 and a coupling 35, 36 that attaches said plate 28, 33 to said pipe section 15, as shown in FIGS. 2-3.

Preferably, the pipe section 15 and plate 28, 33 each have an annular groove 17 and the coupling 35, 36 attaches to said annular groove 17.

More preferably, the pipe section 15 has an annular groove 17, the circular plate 28, 33 has an annular recess 45, 46 and the coupling 35, 36 attaches to both said annular groove 17 and said annular recess 45, 46, as shown in FIGS. 2-3, 13-14, and 17-18.

In some embodiments (and most typically), the invention further comprises a gasket 37 positioned in between the coupling 35, 36 and the plate 28, 30, as shown in FIG. 4.

Preferably, the plate 28 has a plate opening 29 occupied by the rod 33 and wherein the plate 28 is bolted to the anode 20 with a nut 32 that attaches to the rod 30, as shown in FIGS. 2-3.

Preferably, the plate 28, 33 has a plate internally threaded opening 34 occupied by the rod 30 and wherein the plate 28, 33 is threaded to the rod 30 at said internally threaded opening 34.

Figure 11:
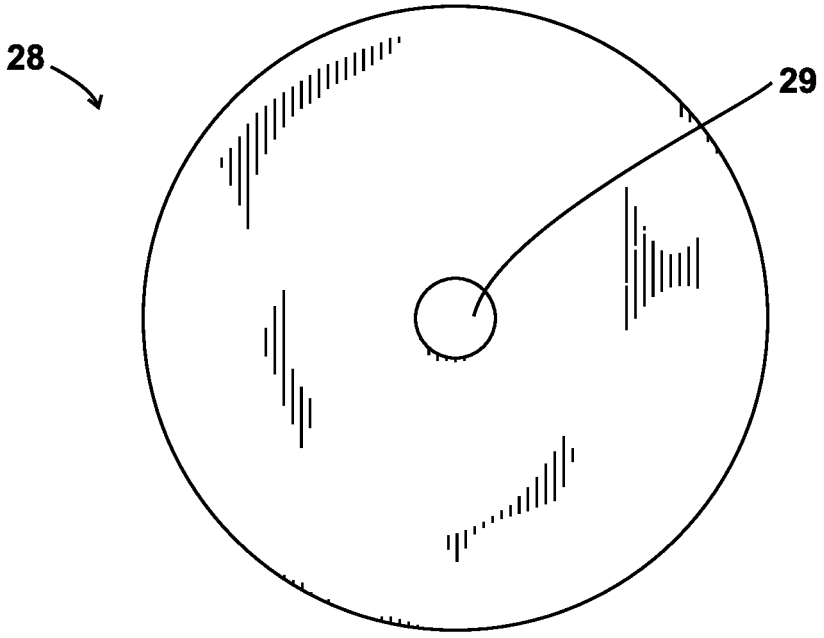
FIG. 11 is a rear view of a preferred embodiment of the cap of a preferred embodiment of the apparatus of the present invention.
Figure 12:
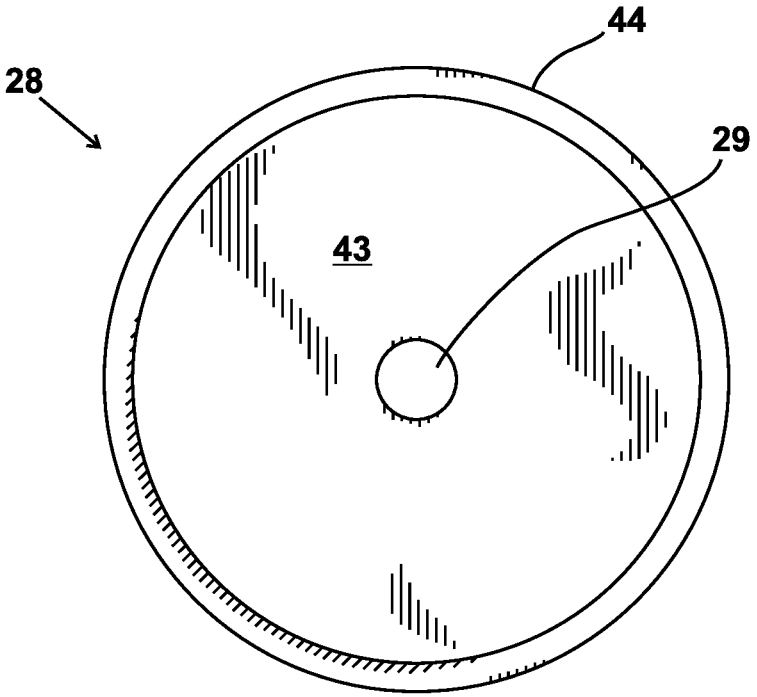
FIG. 12 is a front view of a preferred embodiment of the apparatus of the present invention showing the cap.
Figure 13:
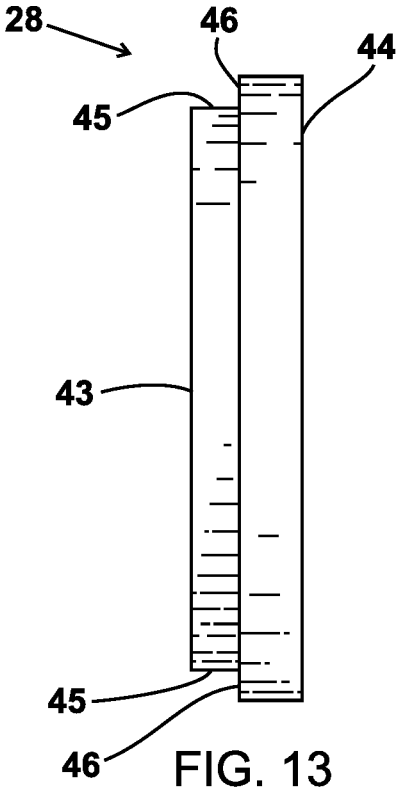
FIG. 13 is a partial side view of a preferred embodiment of the apparatus of the present invention showing the cap.
Figure 14:
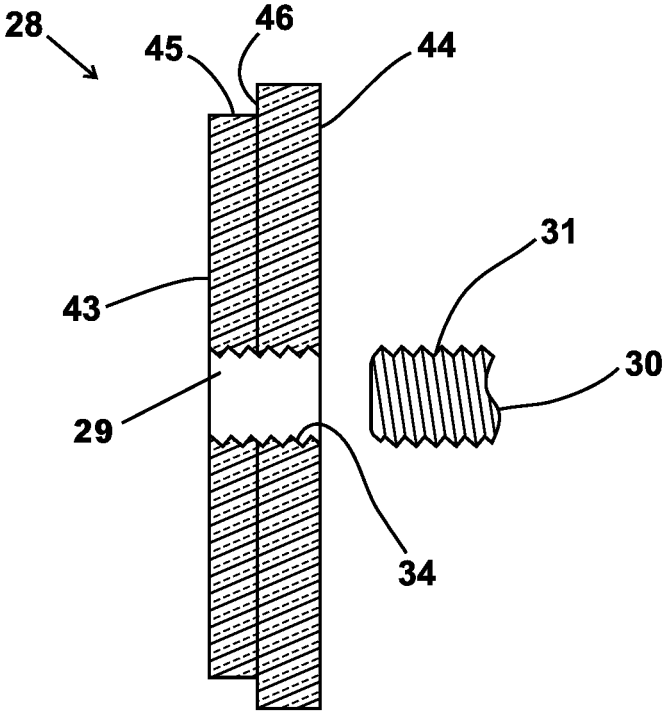
FIG. 14 is a sectional view of a preferred embodiment of the apparatus of the present invention showing the cap.

In some embodiments, the plate 28 has a plate internally threaded opening that extends through the entire thickness of the plate 28, as shown in FIGS. 11, 12, and 14 (openings 29 and 34). In such a case, the rod 30 is threaded through the plate 28 and secured with a nut 32, as shown in FIGS. 2-3.

Figure 15:
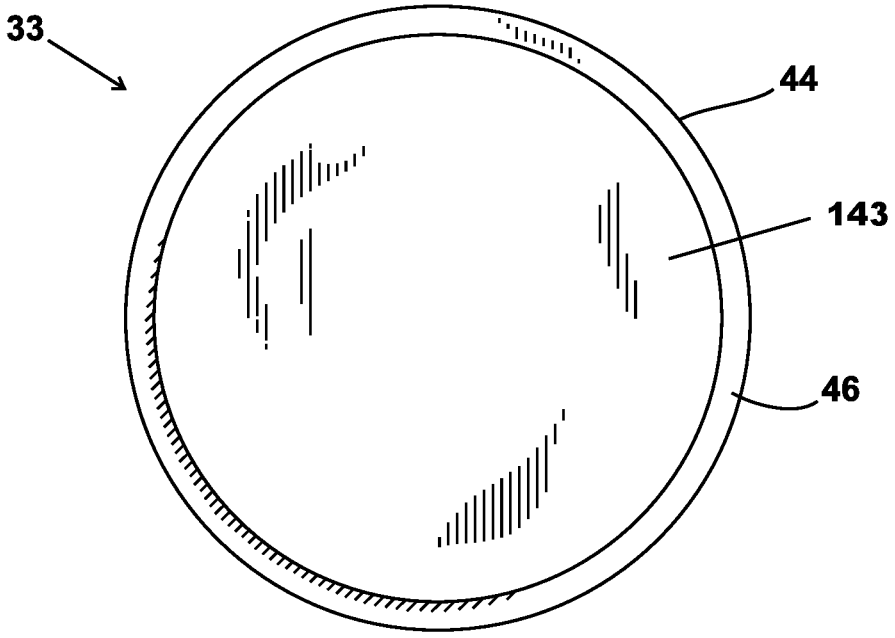
FIG. 15 is a front view of a preferred embodiment of the apparatus of the present invention showing the cap.
Figure 16:
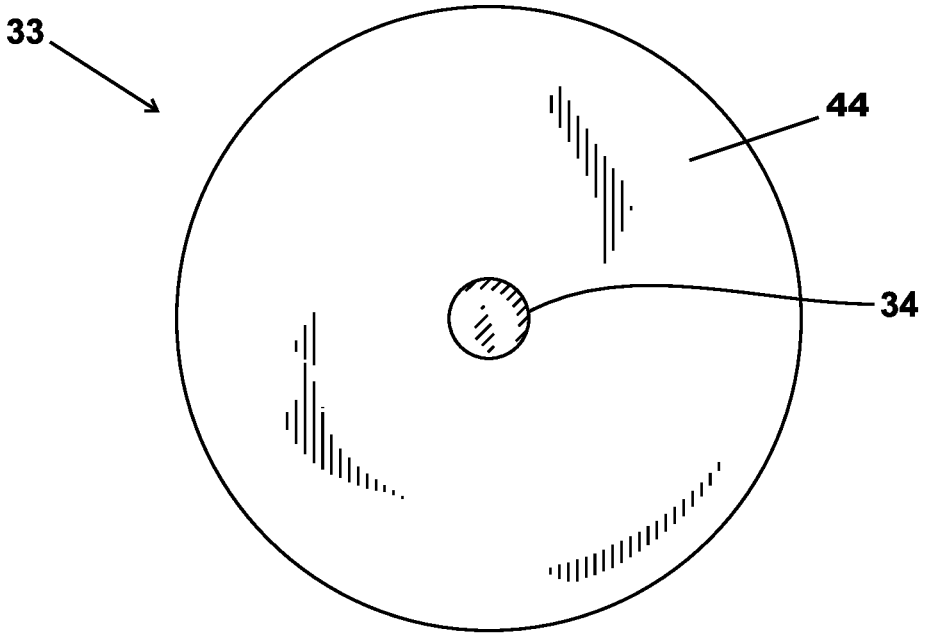
FIG. 16 is a rear view of a preferred embodiment of the apparatus of the present invention showing the cap.
Figure 17:
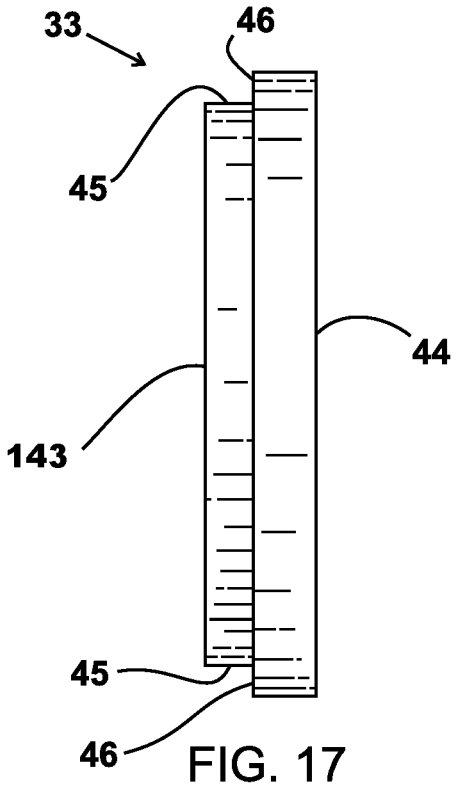
FIG. 17 is a side view of a preferred embodiment of the apparatus of the present invention showing the cap; and, FIG. 18 is a sectional view of a preferred embodiment of the apparatus of the present invention showing the cap.

In some embodiments, the plate 33 has a plate internally threaded opening 34 that does not extend through the entire width of the plate 33, as shown in FIGS. 15, 16, and 18. In such a case, the plate 33 is threadably connected to the rod 30, securing the plate 33 to the anode 20. In this case, smaller diameter section 143 of plate 33 is free of openings which would allow fluid flow through plate 33 when plate 33 is attached to a coupling such as shown in FIG. 4.

The present invention preferably includes a vessel corrosion protection apparatus 20 for a vessel 11 having a vessel wall 12 surrounding a vessel interior 13, a wall opening 9 through the vessel wall 12, a section of pipe 15 connected to the vessel wall 12 at the wall opening 9, said section of pipe 15 having inner and outer end portions and a pipe section inner surface 42 surrounding a pipe section bore 19, and a coupling (including coupling parts 35, 35, bolted connection 50, and gasket 37—see FIG. 4) that attaches to said pipe section 15, the apparatus comprising:

an anode 20 mountable to said pipe section 15 and occupying all or part of said pipe section bore 19 when so mounted;

the anode 20 having an inner end portion 24 that extends into said vessel interior 13 when mounted to said pipe section 15;

the anode 20 having an outer end portion 25 that occupies the pipe section bore 19 in between said inner 22 and outer 21 pipe end portions when mounted to said pipe section 15, said anode outer end portion 25 including a plurality of radially extending projections 26 that engage the pipe section inner surface 42 when the anode 20 is mounted to said pipe section 15;

a plate 33, not made of anodic material, connected to one end of said anode 20 for engagement with the coupling (including coupling parts 35, 35, bolted connection 50, and gasket 37—see FIG. 4), to attach said anode 20 to said vessel 11 by attaching said plate 33 to said pipe section 15, wherein the plate 33 has a face (of section 44) attached to the anode 20 and a face (of section 143—see FIGS. 17 and 18) facing outwardly of the vessel 11 when in the coupling, and the face facing outwardly of the vessel does not have penetrations allowing fluid communication with the vessel. With such a plate 33 pressure testing of the apparatus is not required.

Sections 143 and 44 of plate 33 can be integral or somehow attached securely, as by welding. Sections 43 and 44 of plate 28 can be integral or somehow attached securely, as by welding.

PARTS LIST

The following is a list of parts and materials suitable for use in the present invention:

Parts Number Description
9 vessel/tank wall opening
10 anode, apparatus
11 vessel/tank
12 vessel/tank wall
13 vessel/tank wall interior
14 vessel/tank wall exterior
15 pipe section
16 weld
17 annular groove
19 pipe section bore
20 anode
21 outer end pipe section
22 inner end pipe section
23 outer end of anode
24 inner end of anode
25 cylindrically shaped section of anode
26 projection/rib/fin
27 anode central longitudinal bore
28 circular plate
29 internally threaded plate opening in plate section 43
30 rod
31 external thread
32 nut
33 circular plate
34 internally threaded opening in plate section 44
35 coupling part
36 coupling part
37 gasket
38 annular rib
39 annular rib
40 annular space
41 curved surface
42 internal surface, pipe inner surface
43 smaller diameter section
44 larger diameter section
45 annular shoulder
46 annular surface
47 radially extending surface
48 radially extending surface
50 bolted connection
143 smaller diameter section of plate 33

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A vessel and vessel corrosion protection apparatus, comprising:

a) a vessel having a vessel wall surrounding a vessel interior;

b) a wall opening through the vessel wall;

c) a section of pipe connected to the vessel wall at the wall opening, said section of pipe having inner and outer end portions and an inner surface surrounding a pipe section bore;

d) an anode, including a cylindrical part, the anode mounted to said section of pipe and occupying all or part of said pipe section bore;

e) the anode having an inner end portion that extends into said vessel interior;

the anode having an outer end portion that occupies the pipe section bore in between said inner and outer pipe end portions; and g) wherein the anode outer end portion has a plurality of radially extending projections that are cast with the cylindrical part made of the same material as the anode and that are shaped to engage the inner surface.

2. The vessel and vessel corrosion protection apparatus of claim 1 further comprising an elongated rod embedded in said anode, wherein the rod protrudes from an end of said anode next to said projections.

3. The vessel and vessel corrosion protection apparatus of claim 2 wherein an exposed part of said rod is externally threaded.

4. The vessel and vessel corrosion protection apparatus of claim 1 further comprising a plate threadably connected to one end of said anode and a coupling that attaches said plate to said pipe section.

* * * * *